US005699716A

United States Patent [19]

Ota et al.

[11] Patent Number: 5,699,716

[45] Date of Patent: Dec. 23, 1997

[54] SWASH PLATE TYPE VARIABLE DISPLACEMENT COMPRESSOR

[75] Inventors: Masaki Ota; Youichi Okadome; Hisakazu Kobayashi; Masaru Hamasaki, all of Kariya, Japan

[73] Assignee: Kabushiki Kaisha Toyoda Jidoshokki Seisakusho, Kariya, Japan

[21] Appl. No.: 668,424

[22] Filed: Jun. 4, 1996

[30] Foreign Application Priority Data

Jun. 8, 1995 [JP] Japan ..... 7-142096

[51] Int. Cl.[6] ..... F01B 13/04

[52] U.S. Cl. ..... 92/12.2; 92/57; 92/71; 417/269; 91/505; 74/60

[58] Field of Search ..... 92/12.2, 57, 71; 417/269, 222.1; 91/505; 74/60

[56] References Cited

U.S. PATENT DOCUMENTS 5,517,900 5/1996 Kimura et al. ..... 92/12.2

5,540,559 7/1996 Kimura et al. ..... 92/12.2 X

FOREIGN PATENT DOCUMENTS 63-205470 8/1988 Japan .

444111 1/1992 Japan .

5106552 4/1993 Japan .

791366 4/1995 Japan .

*Primary Examiner*—Hoang Nguyen

*Attorney, Agent, or Firm*—Brooks Haidt Haffner & Delahunty

[57] ABSTRACT

A variable displacement type compressor having a rotary shaft, a swash plate with a through hole into which the rotary shaft is inserted for inclining movement of the swash plate, a lug plate mounted on the rotary shaft, a hinge mechanism between the lug plate and the swash plate for guiding the inclining movement of the swash plate. The displacement of the compressor varies by adjusting the inclined angle of the swash plate. The swash plate is connected through the hinge mechanism to the rotary shaft on two points and directly contacts the rotary shaft at a single contact point located on the inner periphery of the through hole.

16 Claims, 5 Drawing Sheets

SWASH PLATE TYPE VARIABLE DISPLACEMENT COMPRESSOR

BACKGROUND OF THE INVENTION

1. Field of the Invention

The present invention relates to a swash plate type variable displacement compressor, in which the inclined angle of the swash plate is controlled to change the displacement. More particularly, this invention relates to the supporting structure of the swash plate.

2. Description of the Related Art

Japanese Unexamined Patent Publication No. 63-205470 and Japanese Examined Patent Publication No. 4-4411 are known as examples of conventional swash plate type variable displacement compressors. In these compressors, as shown in FIG. 7, a lug plate 50 is attached to a rotary shaft 51. The lug plate 50 rotates integrally with the rotary shaft 51. The swash plate 52 has a through hole 53. The rotary shaft 51 penetrates the through hole 53.

A hinge mechanism 54 is located between the lug plate 50 and the swash plate 52. The hinge mechanism 54 allows the swash-plate 52 to slide along and incline with respect to the rotary shaft 51. The hinge mechanism 54 also allows the swash plate 52 to integrally rotate with the rotary shaft 51. A wobble plate 55 is mounted on the swash plate 52 so that the two plates rotate relative to each other. A single-headed piston 56 is coupled to the wobble plate 55. Rotation of the rotary shaft 51 causes the swash plate 52 to rotate with it. The wobble plate 55 wobbles as the swash plate 52 rotates, thereby causing the piston 56 to reciprocate and compress gas. The displacement of the compressor may be controlled by adjusting the inclined angle of the swash plate 52 in accordance with the difference between the pressure in the crank chamber 57 and the suction pressure.

The through hole 53 is shown in FIG. 8. The through hole 53 limits the movement of the swash plate 52 in the radial direction of the rotary shaft 51, while allowing the plate 52 to slide along and incline with respect to the shaft 51. In the compressor shown in FIG. 7, a mechanical cutting device, such as a reamer, is used to form the through hole 53 of the above described structure. The cutting device is spun with its axis inclined from the center line of the swash plate. While being spun, the device is moved along a specific path to form the through hole 53 shown in FIG. 8.

The hinge mechanism 54 of the compressor has a pin 59 provided on a bracket 58 of the swash plate 52 and also has an elongated hole 61 formed through a tab 60 of the lug plate 50. The swash plate 52 is coupled to the lug plate 50 by interlocking the pin 59 and the hole 61. Thus, the swash plate 52 is coupled to the lug plate 50 at one point.

In order to rotate and incline the swash plate 52 along the rotary shaft 51 steadily, the plate 52 needs to contact the inner wall of the through hole 53 at three points P1, P2 and P3 as shown in FIG. 8. The point P1 is at the opposite side of the rotary shaft from the hinge mechanism, and it serves as a fulcrum to incline the swash plate 52.

In order to form the above described through hole 53 accurately, the adjustment of the path of the cutting device movement requires a complicated control. This increases the manufacturing cost of the compressor.

As a solution for the above mentioned problem, Japanese Examined Patent Publication No. 4-44111 discloses a compressor having an improved swash plate. The through hole of this swash plate has a similar shape in cross section to that of the conventional swash plate shown in FIG. 7. Therefore, the through hole of the examined publication will be explained with reference to FIG. 7. The through hole has a pair of openings formed on either side of the swash plate 52, where the diameter of the hole is largest. The diameter of the hole decreases gradually from the outer ends of the hole toward the center in the axial direction of the hole. Therefore, the through hole has cone-shaped inner walls connected at the center of the plate 52.

A plate initially having a through hole of an even diameter is used to form a through hole of the above described structure. A mechanical cutting device is then moved in the axial and the radial direction of the swash plate so that the hole has conical inner walls. In this method, the cutting device does not need to be moved along a special path. Forming of the through hole is therefore comparatively easy.

A compressor having the above mentioned improved swash plate, however, has a hinge mechanism of substantially the same structure as that of the compressor shown in FIG. 7. Therefore, even the improved swash plate is connected to the lug plate by the hinge mechanism at a single point. The whole surface of the inner wall of the through hole therefore needs to be accurately machined. Although the through hole may be formed by a lathe, whereby the process is easier than the process using a reamer, the process still must be very accurate and therefore is relatively burdensome.

SUMMARY OF THE INVENTION

Accordingly, it is a primary objective of the present invention to provide a swash plate type variable displacement compressor in which the swash plate has a through hole easy to process and in which the swash plate is steadily positioned.

To achieve the foregoing and other objects in accordance with the present invention, an improved swash plate type variable displacement compressor is provided. The compressor includes a housing, a rotary shaft supported in the housing and a swash plate having a through hole. The rotary shaft is inserted into the through hole such that the swash plate is adapted to move so that it inclines with respect to said rotary shaft. The compressor also has a lug plate mounted on the rotary shaft, a hinge mechanism located between the lug plate and the swash plate for guiding the inclining movement of the swash plate and pistons connected to the swash plate for reciprocating in the housing. The pistons serve to draw, compress and discharge a refrigerant gas. The displacement of the refrigerant gas varies by adjusting the inclined angle of the swash plate. The swash plate is connected through the lug plate to the rotary shaft at at least two points of the hinge mechanism. The swash plate contacts the rotary shaft at a single contact point located on the inner periphery of the through hole of the swash plate.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 6(*b*) is a diagrammatic front view of the through hole of the swash plate shown in FIG. 6(*a*);

DETAILED DESCRIPTION OF THE PREFERRED EMBODIMENT

Figure 1:
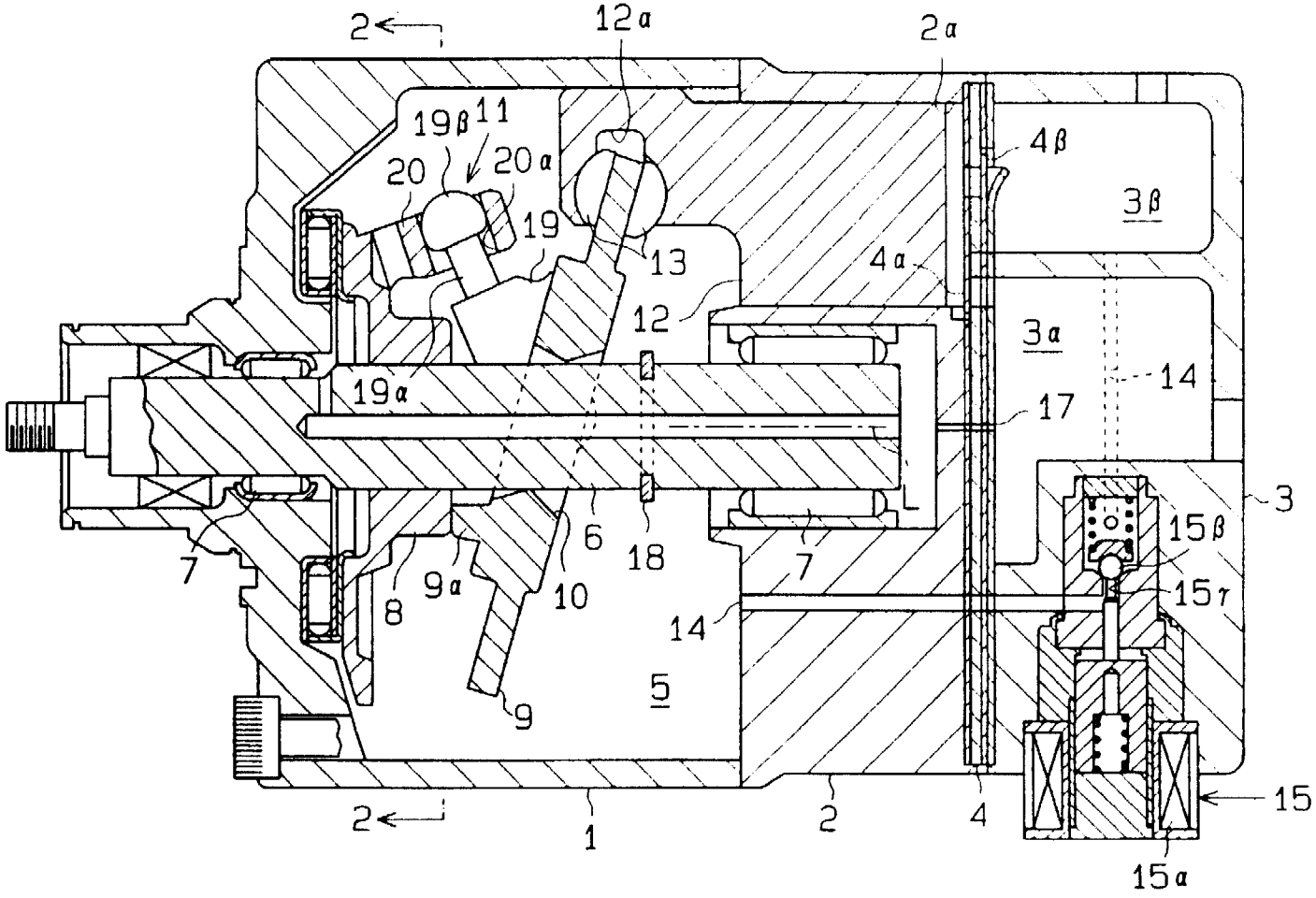
FIG. 1 is a vertical cross-sectional view of a swash plate type variable displacement compressor.

A preferred embodiment of the present invention will now be described. In the FIG. 1, the left is regarded as the front and the right is regarded as the rear. As shown in FIG. 1, a front housing 1 is fixed on the front side of a cylinder block 2. A rear housing 3 is fixed via a valve plate 4 to the rear side of the cylinder block 2 with a valve plate 4 sandwiched therebetween. A suction chamber 3α and a discharge chamber 3β are defined in the rear housing 3. A suction valve 4α and a discharge valve 4β are provided on the valve plate 4. A space enclosed by the front housing 1 and the cylinder block 2 forms a crank chamber 5. In the crank chamber 5, a rotary shaft 6 is rotatably supported with a bearing 7 by the front housing 1 and the cylinder block 2.

A lug plate 8 is attached to the rotary shaft 6. The swash plate 9 has a through hole 10 formed in the center thereof. The rotary shaft 6 is inserted in the through hole 10 in such a manner that the swash plate 9 slides along and inclines with respect to an axis L. The swash plate 9 is coupled with a hinge mechanism 11 to the lug plate 8. The hinge mechanism 11 guides the sliding and inclining motion of the swash plate 9. The swash plate 9 rotates integrally with the rotary axis 6.

A plurality of cylinder bores 2α are formed in the cylinder block 2. A single-headed piston 12 is provided in each cylinder bore 2α. The swash plate 9 is coupled to each piston 12 with a pair of shoes 13 provided on the front and rear sides of the peripheral portion of the swash plate 9. That is, the peripheral portion of the plate 9 is inserted in a recess 12α formed in the front end of each piston 12. The rotation of the swash plate 9 is transmitted through the shoes 13 to each piston 12, thereby causing each piston 12 to reciprocate in the associated cylinder bore 2α. The reciprocal motion of each piston 12 causes the gas in the suction chamber 3α to enter the associated cylinder bore 2α via the suction valve 4α. After being compressed in each bore 2α, the refrigerant gas is discharged via the discharge valve 4β to the discharge chamber 3β.

The pressure in each cylinder bore 2α acts on the face of the associated piston 12 and the pressure in the crank chamber acts on the back of the piston. Controlling the inclined angle of the swash plate 9 by adjusting the difference between these pressures changes the stroke of each piston 12, thereby changing the displacement of the compressor.

A passage formed in the rear housing 3 communicates the discharge chamber 3β and the crank chamber 5. An electromagnetic valve 15 is provided in the passage 14. A ball valve 15β closes a port 15γ by energizing a solenoid 15α of the electromagnetic valve 15. De-energizing the solenoid 15α causes the ball valve 15β to open the port 15γ.

The pressure in the crank chamber 5 is controlled by closing and opening of the passage 14 caused by energizing and de-energizing the electromagnetic valve 15. Closing the passage 14 causes the pressure in the crank chamber 5 to be released via a pressure release passage 16 formed in the rotary shaft 6 and pressure release hole 17 formed on the valve plate 4 to the suction chamber 3α. Accordingly, the pressure in the crank chamber approaches the low pressure in the suction chamber 3α. This increases the inclined angle of the swash plate 9 as illustrated with solid lines in FIG. 1 and alternate long and two short dashes lines in FIG. 3, thereby increasing the displacement of the compressor.

On the other hand, opening the passage 14 causes the high pressure in the discharge chamber 3β to be introduced into the crank chamber 5. This increases the pressure in the crank chamber 5, thereby decreasing the inclined angle of the swash plate 9 as illustrated with a solid line in FIG. 3. The displacement of the compressor decreases accordingly.

The maximum inclined angle of the swash plate 9 is defined by a point at which a stopper 9α formed on the swash plate 9 contacts the lug plate 8. The minimum inclined angle of the swash plate 9 is defined by a point at which the swash plate 9 contacts with a ring 18 provided around the rotary shaft 6.

The structure of the swash plate 9 and the hinge mechanism 11 will now be described in detail.

Figure 2:
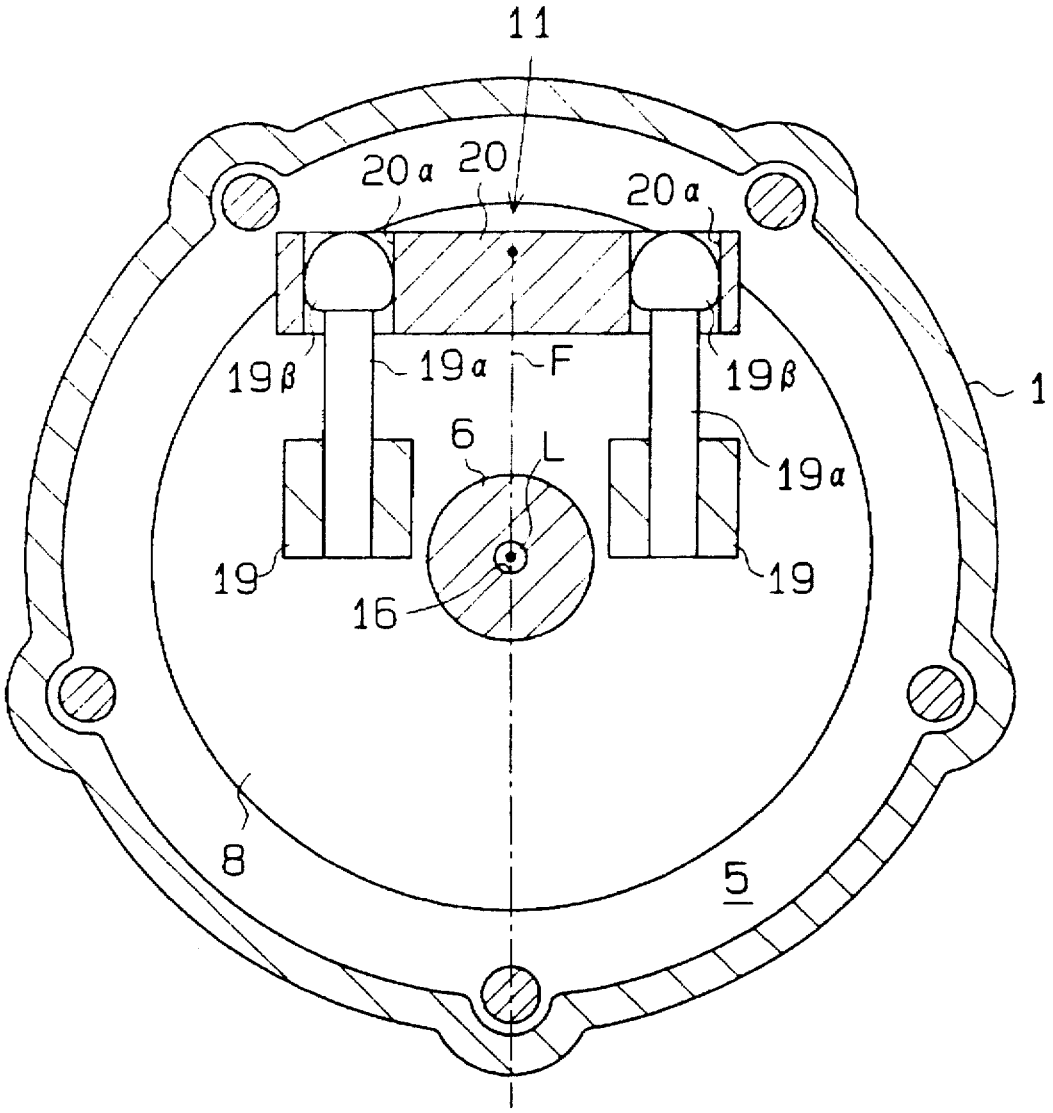
FIG. 2 is a cross-sectional view taken along line 2—2 in FIG. 1.

As shown in FIG. 2, a pair of supporting arms 19, each of which has a guide pin 19α, protrude from the swash plate 9 at both sides of an imaginary plane F containing the center axis L of the rotary shaft 6. A connecting piece 20, which includes a pair of guide holes 20α, is provided on the back of the lug plate 8 so as to correspond with the supporting arms 19. A spherical portion 19β of each guide pin 19α is engaged with the corresponding guide hole 20α, thereby coupling the swash plate 9 to the lug plate 8 at two points. This allows the swash plate to slide along and incline with respect to the rotary shaft 6. The guide pins 19α are press-fitted into the supporting arms 19. The spherical portion 19β of each guide pin 19α is slidable within the corresponding guide hole 20.

Figure 3:
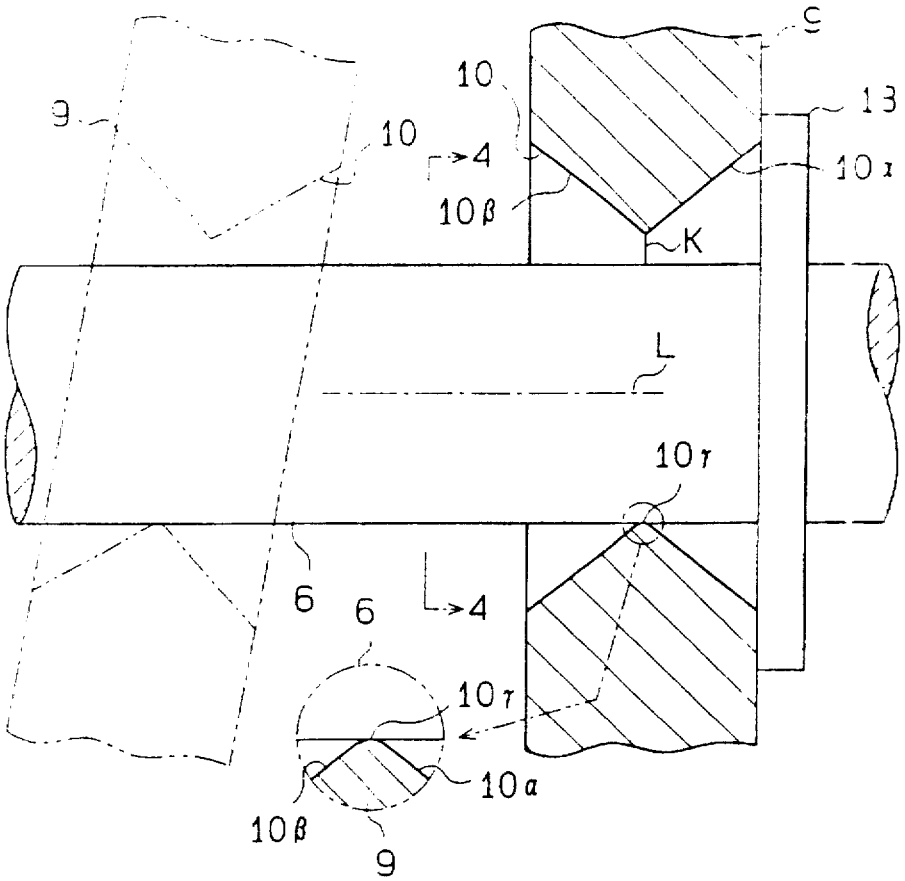
FIG. 3 is an enlarged view, partly in cross section, illustrating a part of the swash plate of FIG. 1.
Figure 4:
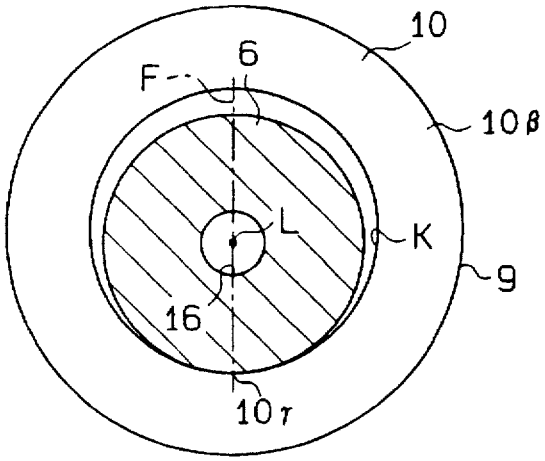
FIG. 4 is a cross-sectional view taken along line 4—4 in FIG. 3.
Figure 5:
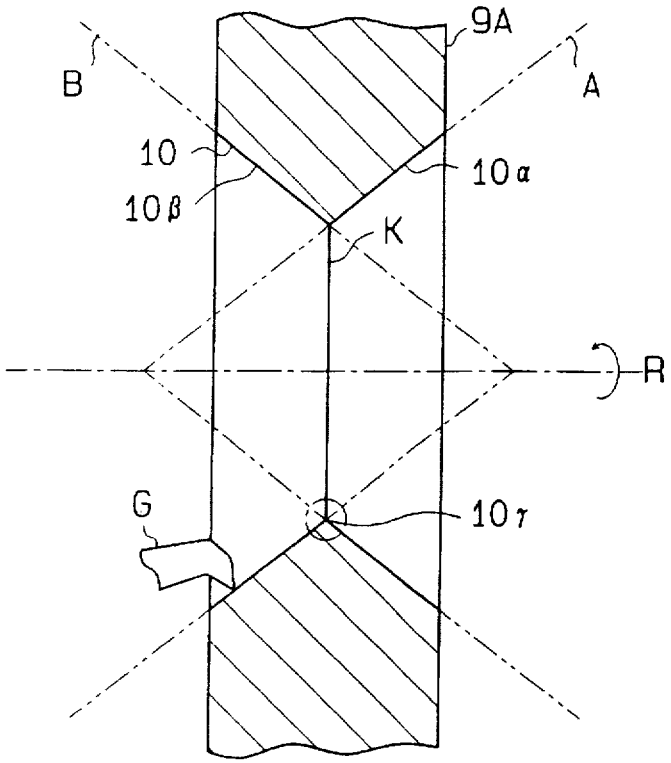
FIG. 5 is a cross-sectional view for explaining a machining method for producing the through hole.

As shown in FIGS. 3 to 5, the through hole 10 has a pair of conical inner peripheral surfaces 10α, 10β corresponding to a pair of cones A, B, which have a diameter decreasing toward the center of the plate. The two inner peripheral surfaces 10α, 10β meet each other at the center of the swash plate, and their meeting place defines an intersection curve or a ring K. The diameter of the ring K is a little larger than the diameter of the rotary shaft 6. The difference of the diameters of the ring K and the shaft 6 is slightly exaggerated in FIGS. 3 to 5 for the purpose of illustration.

In order to form the above described through hole 10, a swash plate work piece 9A is held by a chuck (not shown) as shown in FIG. 5. The work piece is then rotated around a center line R. A cutting tool G is moved along a path which is a straight line intersecting the center line R.

On the ring K, a contact section 10γ located on the opposite side of the rotary shaft 6 from the hinge mechanism 11, contacts the surface of the rotary shaft 6. As shown in the magnified circular portion of FIG. 3, the contact section 10γ is rounded to have an arc-shaped cross section. The angle of the cones A, B is determined such that the contact section 10γ contacts the rotary shaft 6 at a single contact point when the swash plate 9 moves between the minimum inclined angle and the maximum inclined angle.

The position of the swash plate 9 with respect to the rotary shaft 6 is determined by three points, that is, two points in the hinge mechanism consisting of the pair of the guide pins 19α and the guide hole 20α and another point on the contact section 10γ in the through hole 10. Rotation and inclination of the swash plate 9 therefore is stable.

This embodiment further has other effects described below.

On the surface of the through hole 10, the contact section 10γ is the only part that requires highly accurate machining. The other part of the surface needs to be machined only accurately enough to permit the swash plate 9 to slide and incline. This makes the processing of the through hole 10 much easier than that of the prior art in which the whole inner surface of the through hole needs to be machined very accurately.

In this embodiment, the through hole 10 is formed along the two connected cones A, B. This structure allows the through hole 10 to be formed by a relatively simple process, such as cutting with a lathe. This further facilitates forming of the through hole 10. Moreover, the cones A, B have an identical configuration in this embodiment. Therefore, when controlling the cutting tool G in an NC lathe, the data to form the conical surface 10β is obtained by inverting the signs of the data to form the conical surface 10α. This simplifies the program accordingly. The above described effects of the embodiment decrease the manufacturing cost of the compressor.

In this embodiment, the contact section 10γ is rounded. This decreases the bearing stress of the contact section 10γ against the rotary shaft 6, thereby reducing abrasion of the contact section 10γ and the rotary shaft 6.

The contact section 10γ is formed on the opposite side of the rotary shaft 6 from the hinge mechanism 11. A compression reactive force, which acts on the swash plate 9 through each piston 12, is received by the hinge mechanism and the stopper 9α. Distortion of the swash plate 9 is thus prevented.

Even when the compression reactive force urges the swash plate 9 to break off the rotary shaft 9, the engagement of the contact section 10γ and the rotary shaft 6 restrains movement. This ensures the inclination of the swash plate 9 within a predetermined range. The displacement of the compressor is therefore changed securely.

The structure of each part may be modified as described below without departing from the spirit or scope of the invention.

Figure 6A:
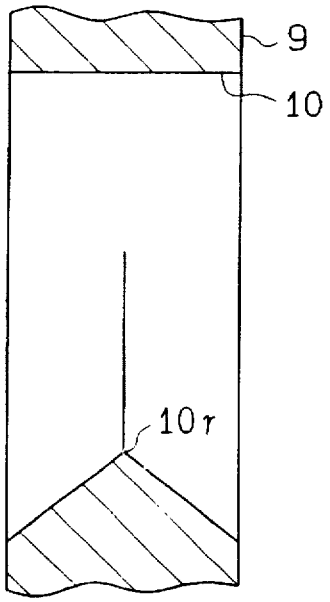
FIG. 6(*a*) is a partial sectional view showing a swash plate of another embodiment.
Figure 6B:
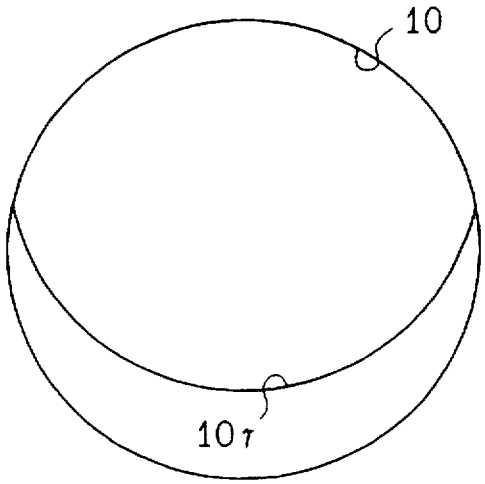

As shown in FIG. 6, except for the contact section 10γ, the inner wall of the through hole 10 may be formed cylindrically.

Figure 7:
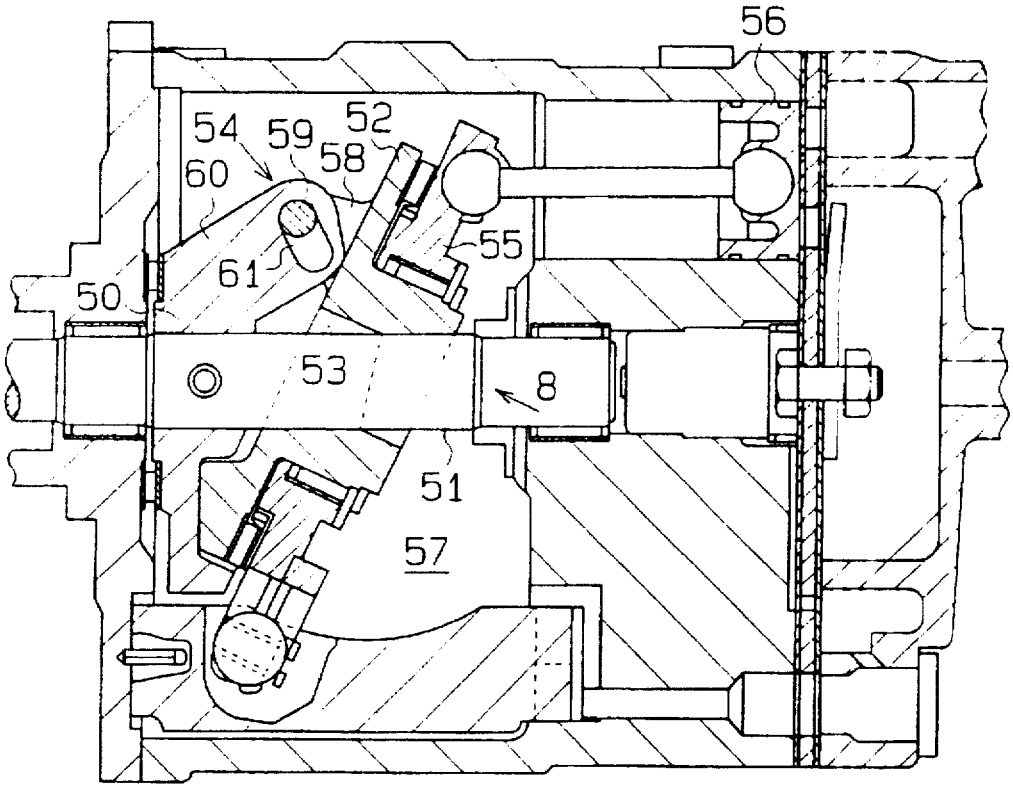
Fig.7 (Prior Art)
FIG. 7 is a cross-sectional view showing a conventional compressor.
Figure 8:
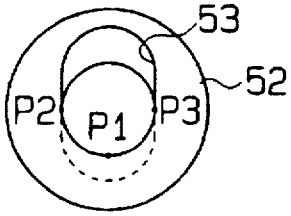
Fig.8 (Prior Art)
FIG. 8 is a diagrammatic view showing the swash plate in FIG. 7 seen from the direction of an arrow 8.

The present invention may be embodied in compressors having a swash plate and a wobble plate having the conventional structure as shown in FIG. 7.

Unlike the above described embodiment, the guide pin 19α may be provided on the lug plate 8 and the guide hole 20α may be provided on the swash plate 9. Or, a single guide pin 19α and a single guide hole 20α may be provided on the swash plate 9, and another guide pin 19α and another guide hole 20α, which correspond to the pin and the hole on the swash plate 9, may be provided on the lug plate 8. Three or more pairs of a guide pin 19α and a guide hole 20α may be provided and the swash plate 9 may be supported by the hinge mechanism 11 at three or more points.

What is claimed is:

1. A variable displacement type compressor comprising:

a housing;

a rotary shaft supported in said housing;

a swash plate having a through hole through which said rotary shaft is inserted such that said swash plate is adapted to move so that it inclines with respect to said rotary shaft;

the inner diameter of said through hole being everywhere larger than the outer diameter of at least that portion of said rotary shaft that is located within said through hole;

a lug plate mounted on said rotary shaft;

a hinge mechanism located between said lug plate and said swash plate for guiding said inclining movement of said swash plate; and a piston connected to said swash plate for reciprocating in said housing, said piston serving to draw, compress and discharge a refrigerant gas, wherein the displacement of said refrigerant gas varies with adjustment of the inclined angle of said swash plate;

wherein said swash plate is connected through said lug plate to said rotary shaft at at least two points of said hinge mechanism and wherein said swash plate contacts said rotary shaft at a single contact point located on the inner surface of said through hole of said swash plate.

2. A compressor according to claim 1, wherein said through hole has first and second openings located on opposite sides of said swash plate, respectively, said through hole including an inner peripheral surface which has a first conical surface formed such that its inner diameter decreases from said first opening toward the center of said swash plate, a second conical surface formed such that its inner diameter decreases from said second opening toward said center of said swash plate, and an intersection curve at which said first and second conical surfaces meet with each other, wherein said single contact point is on said intersection curve.

3. A compressor according to claim 2, wherein said first and second inner peripheral surfaces have an identical configuration.

4. A compressor according to claim 2, wherein said single contact point is on a section having an arc-shaped cross section.

5. A compressor according to claim 2, wherein said hinge mechanism and said single contact point are located on opposite sides of said rotary shaft from one another.

6. A compressor according to claim 5, wherein said hinge mechanism includes:

at least two guide pins, each guide pin having a spherical portion; and guide holes corresponding to said guide pins, wherein each spherical portion of said guide pin engages with each corresponding guide hole.

7. A compressor according to claim 6, wherein said swash plate has a supporting arm, each guide pin being press-fitted into the corresponding supporting arm, and wherein each spherical portion of said guide pin is slidable within each corresponding guide hole.

8. A compressor according to claim 6, wherein at least one of said two guide pins is located on each side of an imaginary plane containing the center axis of said rotary shaft.

9. A compressor according to claim 1, wherein said single contact point is designed to intersect said imaginary plane.

10. A variable displacement type compressor comprising:

a housing;

a rotary shaft supported in said housing;

a swash plate having a through hole through which said rotary shaft is inserted such that said swash plate is adapted to move so that it inclines with respect to said rotary shaft;

the inner diameter of said through hole being everywhere larger than the outer diameter of at least that portion of said rotary shaft that is located within said through hole;

a lug plate mounted on said rotary shaft;

a hinge mechanism located between said lug plate and said swash plate for guiding said inclining movement of said swash plate; and a piston connected to said swash plate for reciprocating in said housing, said piston serving to draw, compress and discharge a refrigerant gas, wherein the displacement of said refrigerant gas varies with adjustment of the inclined angle of said swash plate;

wherein said hinge mechanism includes:

two guide pins, each guide pin having a spherical portion; and guide holes corresponding to said guide pins, wherein each spherical portion of said guide pin engages with each corresponding guide hole; and wherein said swash plate is connected through said lug plate to said rotary shaft at two points located on said hinge mechanism and wherein said swash plate contacts said rotary shaft at a single contact point located on the inner periphery of said through hole of said swash plate.

11. A compressor according to claim 10, wherein said through hole has first and second openings located on opposite sides of said swash plate, respectively, said through hole including a first conical surface formed such that its inner diameter decreases from said first opening toward the center of said swash plate, a second conical surface formed such that its inner diameter decreases from said second opening toward said center of said swash plate, and an intersection curve at which said first and second conical surfaces meet with each other, wherein said single contact point is on said intersection curve.

12. A compressor according to claim 11, wherein said first and second inner peripheral surfaces have an identical configuration.

13. A compressor according to claim 11, wherein said single contact point is on a section having an arc-shaped cross section.

14. A compressor according to claim 10, wherein said hinge mechanism and said single contact point are located on opposite sides of said rotary shaft from one another.

15. A compressor according to claim 10, wherein one of said two guide pins is located on each side of an imaginary plane containing the center axis of said rotary shaft.

16. A compressor according to claim 10, wherein said single contact point is designed to intersect said imaginary plane.

* * * * *